United States Patent [19]

Mahoney

[11] 4,353,548

[45] Oct. 12, 1982

[54] BASKETBALL GOAL ASSEMBLY

[76] Inventor: Kenneth J. Mahoney, Dorrance, Kans. 67634

[21] Appl. No.: 215,647

[22] Filed: Dec. 12, 1980

[51] Int. Cl.[3] ..... A63B 63/08

[52] U.S. Cl. ..... 273/1.5 R

[58] Field of Search ..... 273/1.5 R, 1.5 A, 73 D; 24/16 PB

[56] References Cited

U.S. PATENT DOCUMENTS

| | | | |
|---|---|---|---|
| 1,520,196 | 12/1924 | Medart et al. | 273/1.5 R |
| 2,786,678 | 3/1957 | Fink | 273/1.5 R |
| 2,865,634 | 12/1958 | Townsend | 273/1.5 R |
| 3,102,311 | 9/1963 | Martin et al. | 24/16 PB |
| 3,109,647 | 11/1963 | Austin | 273/1.5 R |
| 3,194,555 | 7/1965 | Humphrey | 273/1.5 R |
| 3,462,143 | 8/1969 | Bidelman et al. | 273/1.5 R |
| 3,595,573 | 7/1971 | Kilbourne | 273/1.5 R |
| 4,026,553 | 5/1977 | Vendramini | 273/73 D X |
| 4,071,238 | 1/1978 | Chapman | 273/1.5 R |
| 4,082,269 | 4/1978 | Hill | 273/1.5 R |
| 4,118,029 | 10/1978 | Septier | 273/73 D |

FOREIGN PATENT DOCUMENTS

| | | | |
|---|---|---|---|
| 1214739 | 12/1970 | United Kingdom | 273/1.5 R |
| 1238182 | 7/1971 | United Kingdom | 273/73 D |

*Primary Examiner*—Paul E. Shapiro

*Attorney, Agent, or Firm*—Phillip A. Rein

[57] ABSTRACT

A basketball goal assembly of this invention is secured to a conventional basketball backboard member. The basketball goal assembly includes (1) a basic support assembly secured to the backboard member; (2) a horizontal rim assembly secured to the basic support assembly; (3) a net support assembly secured to a portion of the rim assembly; and (4) a net member connected to and dependent from the net support assembly. The basic support assembly is constructed of a box shape having no slots, braces, or openings that might catch a person's finger or the like therein. The rim assembly includes a conventional circular, rim member that is braced by solid, rim support members that have no slots or openings to cause injury. The net support assembly includes a net connector member secured to a lower side of the rim member and a connector or anchor member. The net connector member is constructed with a continuous ring section having a plurality of integral, laterally extended connector sections therein. The ring section is secured as by welding to the rim member. The connector sections provide an opening between itself and the adjacent rim member to receive a portion of the net member therein. The connector member is trained over the connector sections and through the portion of the net member to provide vertical support thereto. The connector member can be a cord member made of the net member material; a cable member; a plastic tie member; or the like. An important feature is that the portion of the net member with the connector member fills up the opening between the connector sections and the rim member.

7 Claims, 5 Drawing Figures

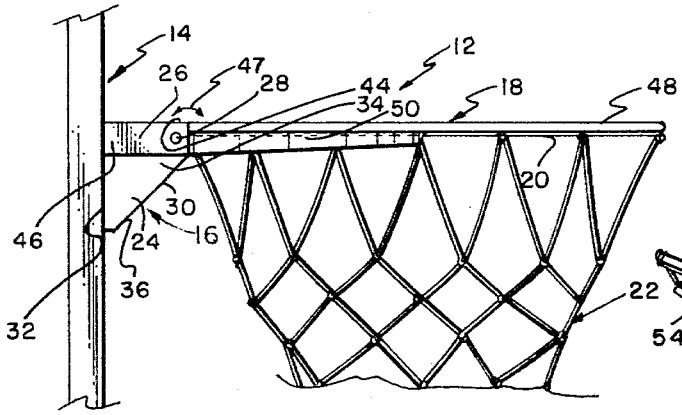
FIG. 1
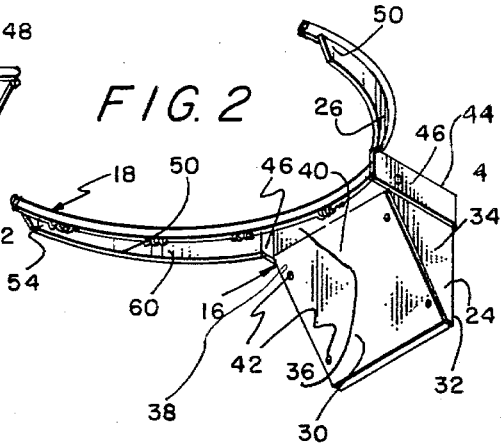
FIG. 2
FIG. 3
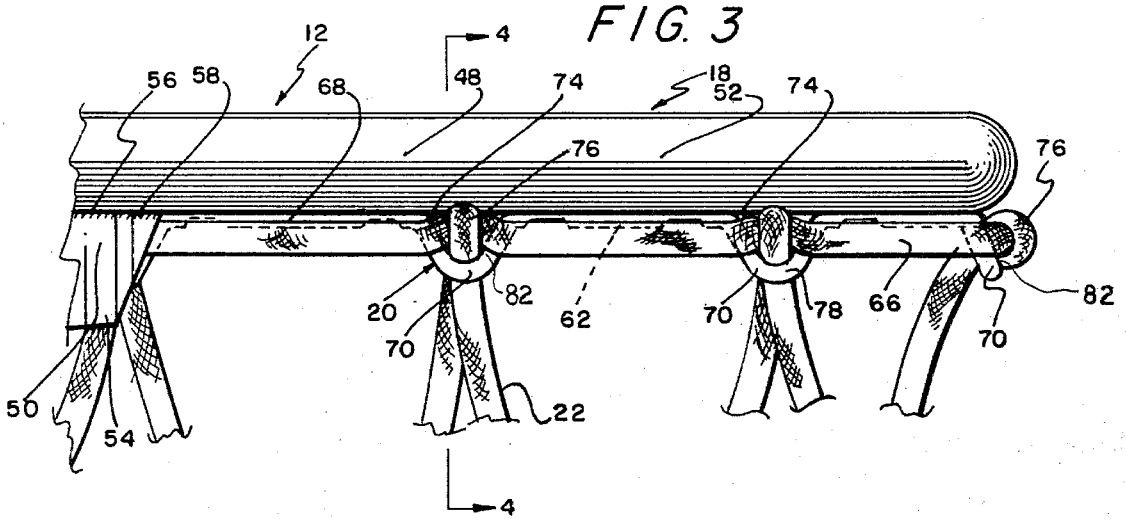
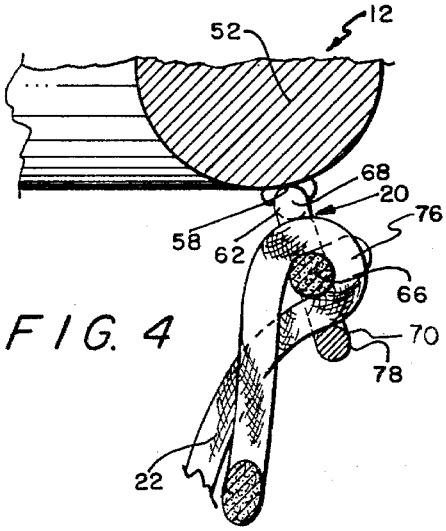
FIG. 4
FIG. 5
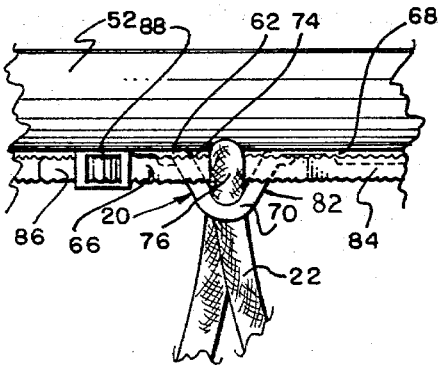

BASKETBALL GOAL ASSEMBLY

PRIOR ART

Numerous types of basketball goal structures are noted in the piror art from a state of the art search as seen in the following United States patents.

U.S. Pat. Nos. 27,067, 1,308,831, 1,520,196, 1,544,453, 2,254,507, 2,489,174, 2,579,312, 2,666,641, 2,707,104, 2,735,680, 2,884,249, 3,109,647, 3,194,555, 3,204,957, 3,313,539, 4,071,238, 4,082,269.

It is seen that numerous patents have issued on basketball goal structures and, more particularly, means for attaching a goal net to support rim member. However, the connector hooks as shown in the Albach et al, Humphrey, Bonham and Ross patents present dangerous structures which can catch a person's finger therein.

None of the patents disclose an overall basketball goal assembly of rigid construction while being constructed to remove danger of injury to a basketball player using same. This is especially important today with the larger basketball players and popularity of the basketball "dunk" shot.

PREFERRED EMBODIMENT OF THE INVENTION

In one preferred embodiment of this invention, a basketball goal assembly is provided that is secured as by nut and bolt members to a conventional basketball backboard member. The basketball goal assembly includes (1) a basic support assembly secured to the backboard member; (2) a horizontal rim assembly secured to the basic support assembly; (3) a net support assembly secured to a portion of the rim assembly; and (4) a net member connected to and dependent from the net support assembly. The basic support assembly is constructed in a box shape having no slots, braces, or openings that might catch a person's finger or the like therein. The rim assembly includes a conventional circular, rim member that is braced by solid, rim support members that have no slots or openings to cause injury. The net support assembly includes a net connector member secured to a lower side of the rim member and a connector or anchor member. The net connector member is preferrably constructed with a continuous ring section hving a plurality of integral, laterally extended connector sections therein. The ring section is secured as by welding to the rim member. The connector sections provide an opening between itself and the adjacent rim member to receive a portion of the net member therein. The connector member is trained over the connector sections and through the portion of the net member to provide vertical support thereto. The connector member can be a cord member made of the net member material; a cable member; a plastic tie member; or the like. An important feature is that the portion of the net member with the connector member fills up the opening between the connector sections and the rim member for safety reasons.

OBJECTS OF THE INVENTION

An object of this invention is to provide a basketball goal assembly of a compact, rigid construction eliminating any net hooks or areas which may catch a basketball player's finger therein for obvious safety reasons.

One object of this invention is to provide a basketball goal assembly having compact rim support members secured to a circular rim member to provide rigidity thereto.

Another object of this invention is to provide a basketball goal assembly having a net support assembly secured to a rim member; and a net member connected to the net support assembly in such a manner to eliminate any hooks or open areas to catch a persons' finger therein for safety reasons.

One other object of this invention is to provide a basketball goal assembly that is rigid in construction; streamline in appearance; usable with standard basketball net members; and presents no braces or open areas to catch a portion of a persons's body or clothing.

Various other objects, advantages, and features of the invention will become apparent to those skilled in the art from the following discussion, taken in conjunction with the accompanying drawings, in which:

FIGURES OF THE INVENTION

FIG. 1 is a side elevational view of a basketball goal assembly of this invention as secured to a portion of a basketball backboard member;

FIG. 2 is a fragmentary perspective view of the basketball goal assembly without a net member connected thereto;

FIG. 3 is a fragmentary side elevational view of the basketball goal assembly illustrating the use of a net support assembly to connect a net member to a basketball rim assembly;

FIG. 4 is a fragmentary sectional view taken along line 4—4 in FIG. 3; and FIG. 5 is a fragmentary side elevational view similar to FIG. 3 illustrating a second embodiment of a net support assembly of this invention.

The following is a discussion and description of preferred specific embodiment of the new basketball goal assembly of this invention, such being made with reference to the drawings, whereupon the same reference numerals are used to indicate the same or similar parts and/or structure. It is to be understood that such discussion and description is not to unduly limit the scope of the invention.

DESCRIPTION OF THE INVENTION

Referring to the drawings in detail and in particular to FIG. 1, a basketball goal assembly of this invention, indicated generally at 12, is shown as secured to a basketball backboard member 14 in a conventional manner. The attachment of the basketball goal assembly 12 to the backboard member 14 presents 90 degree corners without any slots or open areas which may catch a person's finger for obvious safety reasons.

The basketball goal assembly 12 includes (1) a basic support assembly 16 secured to the backboard member 14; (2) a rim assembly 18 secured to the basic support assembly 16; (3) a net support assemby 20 secured to a portion of the rim assembly 18; and (4) a net member 22 connected to the net support assembly 20 and downwardly dependent therefrom.

The basic support assembly 16 is preferrably of a break-away type which releases when an excessive pressure is applied to the rim assembly 18. This type of break-away basketball goal apparatus is set forth in applicant's pending patent application Ser. No. 113,695 filed on Jan. 21, 1980.

The basic support assembly 16 includes a main support housing 24; a top lid section 26 pivotally connected by a support shaft 28 to the main support housing 24;

and an access cover member 30 connected to the main support housing 24. The main support housing 24 has a back wall 32 secured against the backboard member 14; parallel side walls 34 secured to the back wall 32; and a front wall 36 secured to the side walls 34 having an access opening 38 therein.

The access cover member 30 includes a plate member 40 secured to the front wall 36 by anchor or screw members 42. It is obvious that the plate member 40 covers the access opening 38 and is removable for mounting on the backboard member 14 and to gain access to an actuator latch mechanism as set forth in Ser. No. 113,695 filed on Jan. 21, 1980.

The top lid section 26 is generally U-shape in transverse cross section having a top wall section 44 with integral side wall sections 46 connected thereto. The side wall sections 46 fit closely against the adjacent respective side walls 34 for safety reasons. The top lid section 26 is pivotal about the support shaft 28 as shown by the arrow 47.

The rim assembly 18 includes a rim member 48 secured to the top wall section 46 and a pair of opposed rim members 50 secured to the rim member 48 and adjacent side wall sections 46. The rim member 48 has a circular main body 52 constructed of a steel rod material of a conventional size to receive a basketball therethrough.

Each rim support member 50 is an accurate gusset member 54 having a top edge 56 secured as by welding to a lower surface 58 of the adjacent rim member 48. Each gusset member 54 has a main body 60 tapered outwardly to a narrow portion to provide rigidity but allow uniform flexibility to the entire width of the basic support assembly 16 and the rim member 48. The gusset members 54 eliminate (1) the need for support rods; and (2) open areas that might catch a person's hand, finger, etc.

The net support assembly 20 includes a net connector member 62 secured to the lower surface 58 of the rim member 48 and an anchor or connector member 66 used to connect the net member 22 to the net connector member 62. The net connector member 62 consists of a circular ring section 68 with a plurality of connector sections 70 therein.

The ring section 68 is of a diameter less than the rim member 48 and secured to the surface 58 as by welding as shown in FIG. 4.

Twelve of the connector sections 70 are used to properly support the net member 22 and are of generally U-shape having an opening 74 that is filled with connector loop 76 of the net member 22 in a manner to be explained. The connector sections 70 are formed from an adjacent portion of the ring section 68 and extend downwardly and laterally of the ring section 68.

More particularly as noted in FIG. 4, each connector section 70 is inclined downwardly and slightly outwardly of a vertical plane through the axis of the rim member 48 and within the confines of a vertical plane through the outer surface of the rim member 48.

This positioning of the connector sections 70 is very important when a basketball is spinning around the rim member 48 because, as observed on other available rim assemblies and net connector members, the basketball hits the net connector members and is thrown upwardly and outwardly of the rim member 48. This is a very undesirable action which does not occur in the invention described herein.

The anchor or connector member 66 can be of a flexible or semi-rigid material which is trained through respective connector loops 76 of the net member 22 (FIG. 3). The connector member 66 can be a cord member made of the same material as the net member 22 and having adjacent loose ends tied together. It is obvious that downward movement of the net member 22 would be prevented by the connection of the anchor member 66 to the connector loops 76. The anchor member 66 would contact an upper surface 82 of the connector sections 70 to resist downward movement of the net member 22.

As seen in FIG. 5, the anchor member 66 can be a plastic strap member 84 having loose ends 86 connected by a one-way latch member 88. This provides an anchor member 66 which can be easily trained through the connector loops 76 and then easily tightened on insertion of a loose end 86 through the latch member 88.

The anchor member 66 can be a metal cable member with opposite ends firmly secured such as by welding, clamps, padlock, etc. to prevent the stealing of the net members 22 from unguarded areas such as play grounds, public facilities, etc.

The net member 22 is of a conventional nature usually constructed of a nylon cord material. The connector loops 76 are inserted through the respective openings 74 from inside to the outside and connected to the anchor member 66. (FIG. 4) This completely fills up the openings 74 for obvious safety reasons.

USE AND OPERATION OF THE INVENTION

On use of the basketball goal assembly 12 of this invention, the basic support assembly 16 is bolted to the backboard member 14 in a conventional manner. As noted in FIG. 1, the rim member 48 extends in a normal horizontal plane when in the usage condition. The rim member 48 is pivotal about the support shaft 28 when an excessive downward force is applied thereto as shown by the arrow 47. The actuator latch mechanism to accomplish this result is set forth in applicant's pending patent application Ser. No. 113,695, filed Jan. 21, 1980.

It is noted that the basic support assembly 16 and rim assembly 18 presents straight lines and no openings or braces where a basketball player may catch a finger or the like thereon. This is an important feature of the invention as serious injury has resulted from catching a finger on the conventional loop type hook members used to support basketball net structures such as the net member 22.

Next, the connector loops 76 are inserted through respective ones of the openings 74 as noted in FIG. 4. The anchor member 66 is trained through the respective connector loops 76 with adjacent loose ends 86 connected to each other. This can be done by tying loose ends or, if using the strap member 84, by use of the latch member 88.

It is seen that the net member 22 is held up by the strength of the anchor member 66 and the material of the net member 22 at the connector loops 76. Such is designed and selected to unlatch the rim member 48 or break the net member 22 or anchor member 66 before injury to a basketball player who may have become entangled in the member 22.

It is obvious that the net member 22 can easily be replaced using the net support assembly 20 of this invention.

The basketball goal assembly of this invention is safe to use; sturdy inconstruction; easy to mount and maintain; and removes all structural features that may cause injury to a basketball player using same.

While the invention has been described in conjunction with preferred specific embodiments thereof, it will be understood that this description is intended to illustrate and not to limit the scope of the invention, which is defined by the following claims:

I claim:

1. A basketball goal assembly adapted to be connected to a basketball backboard member, comprising:

(a) a basic support assembly connectable to the backboard member;

(b) a rim assembly having a rim member secured to said basic support assembly;

(c) a net support assembly connected to said rim assembly having a net member connected thereto;

(d) said net support assembly including a net connector member secured to a lower area of said rim member;

(e) said net connector member having dependent connector sections secured thereto to receive a portion of said net member;

(f) each of said connector sections and said rim member forming an opening there between receiving portion of said net member therein from one side thereof;

(g) said net support assembly further including an anchor member trained through said portion of said net member from the other side of said opening to provide vertical support thereto; and (h) said portion of said net member and said anchor member within respective ones of said openings of a conjoint size to fill the area in said opening to prevent insertion of a person's finger therein.

2. A basketball goal assembly as described in claim 1, wherein:

(a) said basic support assembly is of an enclosed box shape to provide rigidity to said rim assembly without any open area to prevent insertion and possible injury to a part of a basketball player's body.

3. A basketball goal assembly as described in claim 1, wherein:

(a) said connector sections are spaced about said rim member and extended downward and outwardly laterally of said rim member within an area defined as between a vertical plane through an axis of said rim member and a vertical plane touching an outer surface of said rim member.

4. A basketball goal assembly as described in claim 1, wherein:

(a) each of said connector sections is of a loop shape and is sized to receive only respective one's of said portions of said net member and said anchor member therein.

5. A basketball goal assembly as described in claim 1, wherein:

(a) said anchor member is constructed of a highly unbreakable material having opposed ends secured together to prevent unauthorized removal of the net member.

6. A basketball goal assembly as described in claim 1, wherein:

(a) each said portion of said net member is less than the size of said each said opening;

(b) said anchor member is of a thickness less than the size of said opening; and (c) said portion of said net member and said anchor member are of a collectively size equal to said opening in order to fill same.

7. A basketball goal assembly as described in claim 1, wherein:

(a) said portions of said net member are connector loops which are inserted through respective ones of said openings; and (b) said anchor member is trained through said connector loops and rests on an upper surface of said connector sections to prevent downward movement of said connector loops through respective ones of said openings.

* * * * *